United States Patent [19]

Nakama

[11] 4,079,484

[45] Mar. 21, 1978

[54] BINDING CLIP

[75] Inventor: Daiji Nakama, Utsunomiya, Japan

[73] Assignee: Nifco Inc., Tokyo, Japan

[21] Appl. No.: 707,180

[22] Filed: Jul. 21, 1976

[30] Foreign Application Priority Data

Jul. 25, 1975 Japan ..... 50-102288[U]

[51] Int. Cl.[2] ..... B65D 63/00

[52] U.S. Cl. ..... 24/16 PB

[58] Field of Search ..... 24/16 PB, 30.5 P, 30.5 T, 24/237, 30.5 R

[56] References Cited

U.S. PATENT DOCUMENTS

| | | | |
|---|---|---|---|
| 2,685,193 | 8/1954 | Marymont | 24/237 X |
| 3,043,547 | 7/1962 | Reich | 24/237 X |
| 3,535,746 | 10/1970 | Thomas | 24/30.5 T |
| 3,543,353 | 12/1970 | Meehan | 24/16 PB |
| 3,882,573 | 5/1975 | Thomas | 24/30.5 T |

*Primary Examiner*—Doris L. Troutman

*Attorney, Agent, or Firm*—Jack R. Halvorsen; Robert W. Beart

[57] ABSTRACT

Disclosed is a binding clip which comprises an elastic filamentous portion approximately in the shape of the Greek letter "Ω" (omega) and head portions possessed of mutually engageable means attached one each to the extremities of said filamentous portion. After a linear article has been encircled by the filamentous portion of said binding clip, the head portion thereof is brought into inseparable engagement by winding the head portion for thereby twisting the ends parts of the filamentous portion around each other and coupling the mutually engageable means with each other.

4 Claims, 7 Drawing Figures

BINDING CLIP

BACKGROUND OF THE INVENTION

This invention relates to an approximately Ω-shaped filamentous elastic clip made of a rigid synthetic resin and used for binding electric wires and other similar articles. By the expression "Ω-shaped" is meant the shape of a ring containing an opening at one portion, which is formed by shaping a circularly curved binding ring body and bending the abuttingly confronting extremities of said ring in mutally separating directions.

Heretofore there has been proposed a binding clip which comprises an Ω-shaped filamentous body of a synthetic resin such that said filamentous body is closed and tightened up around cordlike articles embraced therein to provide fast binding of said articles when the fastening parts which are bent in the mutually separating directions at the opposed ends of said body are twisted around each other and brought into mutually hooking engagement. This binding clip has served the sole purpose of closing the filamentous body in an annular shape by causing the two fastening parts at the opening to be brought into hooking engagement. Owing to this construction, this binding clip is fairly apt to be disconnected even by a slight touch in the course of the binding work. With the clips of such principles, the engagement of the fastening parts is readily destroyed particularly where the number of linear articles to be bound with the clips is unusually small or unusually large.

The object of the present invention is to provide a binding clip whose filamentous binding portion is not subject to easy accidental disconnection and which permits the binding work involved to be performed with simplicity.

SUMMARY OF THE INVENTION

To accomplish the object described above according to the present invention, there is provided a binding clip which comprises an approximately Ω-shaped filamentous elastic portion and a head portion possessed of mutually engageable fastening means disposed one each at the extremities of said filamentous portion.

When linear materials subjected to binding are embraced by said filamentous portion, the end parts of said filamentous portion are twisted around each other and the fastening means at the extremities are coupled with each other. The binding clip thus brought into the bound state will not easily disconnect. Moreover, since the binding clip of this invention has a simple construction, it can easily be adapted for the conventional injection molding technique for plastics.

The other objects and characteristic features of this invention will become apparent from the description of the invention given in further detail hereinafter with reference to the accompanying drawing.

DESCRIPTION OF THE PREFERRED EMBODIMENT

Figure 1:
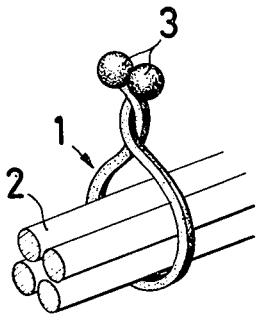
FIG. 1 is an explanatory diagram of the conventional Ω-shaped binding clip.

FIG. 1 illustrates one example of the binding clip of the conventional principle. It comprises an approximately Ω-shaped filamentous portion 1 and spherical head portions 3 attached one each to the extremities of said filamentous portion 1. This clip has served the purpose of binding linear articles 2 by causing said linear articles 2 to be embraced by said filamentous portion 1 and twisting the head portions around each other for fast entangling engagement. When this conventional clip is used such as for binding internally distributed wires within an acoustic instrument such as a television set, a slight touch of the head portions 3 of said clip 1 inadvertently made in the course of subsequent assembly of printed circuit boards and various parts frequently results in disconnection of the bound clip. The entangling engagement of the head portions 3 especially tends to come loose where the overall cross section of wires being bound by this clip approaches the upper limit or lower limit of the allowable range.

This invention makes the best of the simplicity of use which the conventional Ω-shaped binding clip offers and, at the same time, overcomes the disadvantage of easy disconnection by disposing mutually engageable fastening portions one each at the head portions, i.e., the extremities of the filamentous portion.

Figure 2:
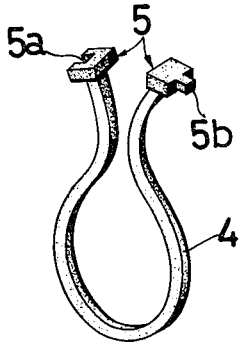
FIG. 2 is a diagram illustrating one preferred embodiment of the binding clip of the present invention, in a state yet to be bound.
Figure 3:
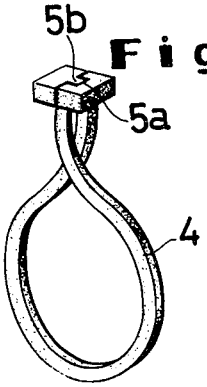
FIG. 3 is a diagram illustrating the binding clip of FIG. 2 in a bound state.

FIG. 2 illustrates one preferred embodiment of this invention held in an open state and FIG. 3 illustrates the same preferred embodiment in its bound state. This preferred embodiment is characterized in that the Ω-shaped elastic filamentous portion 4 is provided at each extremity thereof with an integrally formed head portion 5 and the heads 5 are provided one each with fastening portions **5*a* and 5*b*. The fastening portions 5*a* and 5*b*' are adapted so that they come into mutual engagement when the end parts of the filamentous portion 4 are brought into contact in a crossed state as illustrated in FIG. 3. In this manner, the depression in the fastening portion 5*a* and the protrusion in the other fastening portion 5*b* are coupled with each other. Since this coupling of the fastening portions is achieved by forcing the Ω-shaped filamentous portion 4 into assuming a crossed state, the reactional force or resilient force due to the deformation of said filamentous portion 4 functions so as to retain the two fastening portions in their bound state. Although the conventional clip similarly retains the entangling engagement of the head portions by virtue of the resilient force of the filamentous portion, an external force exerted on one of the spherical head portions 3 causes a change in the relative position of the two spherical head portions and results in disconnection thereof. By contrast in the case of this invention, since the fastening portions 5*a* and 5*b* are coupled with each other, the external force exerted by an inadvertent touch causes the two fastening portions 5***a* and 5*b* to be pushed away in unison and will not be caused to come loose from each other.

The shape of the fastening portions 5*a* and 5*b* has only to be such that said fastening portions fulfill their function by being coupled with each other when the end parts of the filamentous portion 4 have been brought into a mutually crossed state. Consequently, the reactional force which the articles bound by the clip exerts against the binding force also operates in the direction of retaining the fastening portions in their coupled state.

Figure 4:
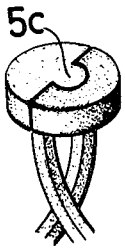
FIG. 4 is an explanatory diagram illustrating a part of the binding clip as the second preferred embodiment of this invention.
Figure 5:
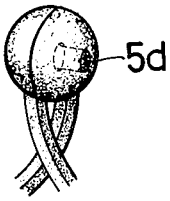
FIG. 5 is an explanatory diagram illustrating a part of the binding clip as the third preferred embodiment of this invention.

FIGS. 4–5 illustrate two other preferred embodiments of the fastening portions. Those of FIG. 4 are intended to render disconnection of the bound fastening portions particularly difficult by giving the protrusion 5*c* a partially cylindrical shape. The fastening portions shown in FIG. 5 are complementary hemispheres, with a protrusion 5*d* formed on one of said hemispheres and a matching depression formed on the other hemisphere, so that when the two hemispheres are united by coupling said protrusion and depression, they form a perfect sphere.

Figure 6:
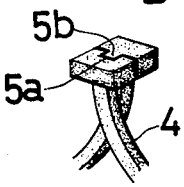
FIG. 6 is an explanatory diagram illustrating a part of the binding clip as the fourth preferred embodiment of this invention.
Figure 7:
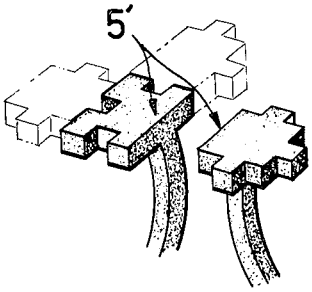
FIG. 7 is an explanatory diagram illustrating a part of the binding clip as the fifth preferred embodiment of this invention.

FIG. 6 illustrates a case wherein the orientation of the engaging protrusion and depression formed on the fastening portions 5*a* and 5*b* is turned by 90° relative to those of FIG. 2 or FIG. 3. In this case, the reactional force which the filamentous portion 4 exerts against the bending force and which contributes to retaining the fastening portions in their bound state operates preponderantly in a plane perpendicular to the plane containing the Ω-shaped filamentous portion, whereas in the clips of FIGS. 2–3, the reactional force operates in a plane containing the Ω-shaped portion. In other words, the reactional force which is exerted against the bending force because the crossed points of the end parts of the filamentous portion 4 are pressed against and twisted around each other operates in the direction of pressing the engaging faces of the fastening portions against each other. FIG. 7 illustrates a combination of the preferred embodiment of FIGS. 2–3 and that of FIG. 6; each head portion 5' contains an engaging depression (or protrusion) on each of three sides so that the two head portions may be coupled as indicated by dotted lines.

The present invention admits of numerous variations and modifications to its embodiments besides the small number of preferred embodiments described above.

This invention originated in an investigation conducted into the cause for the easy disconnection, an inherent disadvantage suffered by the conventional Ω-shaped binding clip. It has consequently been accomplished by overcoming this disadvantage with a simple improvement which consists in incorporating matched fastening portions into the head portions. Having added to the operational reliability of the Ω-shaped clip without sacrificing the characteristic features of simple handling and low price, this invention will serve the purpose of enhancing the efficiency of assembling work, improving the product quality and increasing the number of uses to be found for the Ω-shaped clip.

What is claimed is:

1. A one-piece resilient plastic binding clip which comprises an approximately omega-shaped filamentous resilient portion and substantially rigid head portions disposed one each at the extremities of said filamentous portions, said head portions extending laterally of said filamentous portion and being provided with mutually engageable fastening means which confront each other when the end parts of said filamentous portion are twisted around each other, said fastening means including a protrusion of a rectangular cross section and a depression complemental to said protrusion.

2. A one-piece resilient plastic binding clip which comprises an approximately omega-shaped filamentous resilient portion and substantially rigid head portions disposed one each at the extremities of said filamentous portions, said head portions extending laterally of said filamentous portion and being provided with mutually engageable fastening means which confront each other when the end parts of said filamentous portion are twisted around each other, said fastening means including on one head portion a protrusion of a partially cylindrical shape and a depression complemental to said protrusion on the other head portion, said protrusion and depression each having an axis which is disposed substantially parallel to said filamentous portion at its connection to said head portions.

3. The binding clip according to claim 1, wherein said head portions are provided with at least three matched fastening means.

4. The binding clip according to claim 2 wherein said head portions are provided with at least three matched fastening means.

* * * * *